US009334787B2

(12) United States Patent
Pirolo et al.

(10) Patent No.: US 9,334,787 B2
(45) Date of Patent: May 10, 2016

(54) CURVED PLATE FOR EXHAUST REVERSION PREVENTION

(71) Applicants: Kevin Pirolo, Byhalia, MS (US); Devin Ray Bright, Hickory Flat, MS (US)

(72) Inventors: Kevin Pirolo, Byhalia, MS (US); Devin Ray Bright, Hickory Flat, MS (US)

( * ) Notice: Subject to any disclaimer, the term of this patent is extended or adjusted under 35 U.S.C. 154(b) by 116 days.

(21) Appl. No.: 14/139,017

(22) Filed: Dec. 23, 2013

(65) Prior Publication Data

US 2014/0174062 A1 Jun. 26, 2014

Related U.S. Application Data

(60) Provisional application No. 61/745,993, filed on Dec. 26, 2012.

(51) Int. Cl.
*F01N 13/00* (2010.01)
*F01N 13/18* (2010.01)

(52) U.S. Cl.
CPC ..... *F01N 13/1822* (2013.01); *F01N 2240/20* (2013.01); *F01N 2450/10* (2013.01)

(58) Field of Classification Search
CPC ..... F01N 1/08; F01N 1/086; F01N 1/163; F01N 1/165; F01N 1/166; F01N 13/1855; F01N 3/2892; F01N 2340/20; F01N 1/088; F01N 1/161; F01N 1/18; F01N 2240/36; F01N 2260/14; F01N 2450/24; F01N 2610/16; B01F 5/0616; B01F 5/0618; B01F 2005/0628; B01F 2005/0635; B01F 2005/0637; B01F 2005/0638
USPC ..... D12/194
See application file for complete search history.

(56) References Cited

U.S. PATENT DOCUMENTS 3,346,071 A * 10/1967 Lader ..... F01N 1/165 181/236
3,877,339 A * 4/1975 Muenchinger ..... F16B 39/24 411/131
2005/0115763 A1* 6/2005 Maybeck ..... F01N 1/08 181/217

FOREIGN PATENT DOCUMENTS

DE 3618062 A1 * 12/1987 ..... B29B 7/30
FR 1059584 A * 11/1953 ..... F01N 1/08

OTHER PUBLICATIONS

Machine translation of FR 1059584 A, accessed on Jun. 15, 2015.*

* cited by examiner

*Primary Examiner* — Jonathan Matthias

(57) ABSTRACT

An exhaust reversion prevention plate is installed within the exhaust pipe of an internal combustion engine in order to prevent a phenomenon known as reversion, which causes a reduction of power available to the engine. A curved plate is affixed within the exhaust pipe with a threaded stud welded to the plate. The curved plate has a wave shape resembling a sinusoidal wave with several peaks and valleys, which are angularly spaced equally around the central axis of the curved plate.

6 Claims, 7 Drawing Sheets

CURVED PLATE FOR EXHAUST REVERSION PREVENTION

The current application claims a priority to the U.S. Provisional Patent application Ser. No. 61/745,993 filed on Dec. 26, 2012.

FIELD OF THE INVENTION

The present invention relates generally to automobile exhaust systems. More specifically, the present invention is an exhaust system insert intended to prevent reversion which is known to happen in certain engines and can reduce the amount of horsepower that is produced by the engine.

BACKGROUND OF THE INVENTION

Humanity has always had a desire to go from one location to the next as fast as possible. In some cases the actual relocation is not even the point of the trip but instead the speed achieved, sights seen or other experiences obtained during the trip. To this end, internal combustion engines have been used in motorized vehicles since the invention of the automobile by Karl Benz in 1885. The very first motorcycle was also invented in 1885 by the pair of German inventors; Gottlieb Daimler and Wilhelm Maybach. Ever since the invention of these two motorized vehicles, people have always sought to improve them; to increase the power produced by their engines; to increase their handling; to make them go faster. Many innovations and breakthrough have accomplished great improvements in various aspects of the performance of motor vehicles; however, there is still room for improvement even in the modern day. To understand this opportunity for improvement, one specific aspect of the internal combustion engine is examined: the exhaust system. Internal combustion engines operate on one crucial principle: a fuel air mixture is combusted within a chamber to generate a massive force on a piston which causes the rotation of a driveshaft. The driveshaft transmits that rotational motion to the wheels of the vehicle. The wheels of the vehicle subsequently transmit the force to the road which drives the vehicle forward by way of friction between the tires and the road surface. After combustion of the fuel air mixture takes place, residue and other remaining waste gasses must be expelled from the combustion chamber. The exhaust exits the combustion chamber through the exhaust valve. Many motor vehicles possess more than one piston, and as such there are several different methods of making the exhaust from all of the pistons converge into one flow to prevent the need for having an excessive number of mufflers sticking out the rear of the vehicle.

There is a phenomenon which can occur in the exhaust system of motor vehicles known as reversion. This phenomenon arises from the nature of the way in which the exhaust leaves the engine of the vehicle. The exhaust exits the engine and travels through the exhaust system. Due to the cyclical, discontinuous nature of piston engines, rapid pulses are created due to new packets of exhaust being introduced to the system. These exhaust pulses are longitudinal waves which travel through the exhaust system at about 1700 ft/s, while the exhaust gasses travel at about only 200 ft/s. The problem with this is that sometimes this exhaust pulse can lose speed as it travels out of the exhaust system. If too much speed is lost, the exhaust can actually reverse flow, preventing all of the combustion products from being expelled from the combustion chamber. This can steal horsepower from the engine and cause buildup of exhaust particles which also drains the power of the engine over time. Therefore, it is an object of the present invention to create a device which can prevent or reduce the reversion of exhaust flow, thus improving power output from the engine. Additionally, it is an object of the present invention to avoid the creation of backpressure in the exhaust system, an effect that is also known to reduce the power output of an internal combustion engine. The present invention is an aftermarket exhaust add on that is specifically designed to be installed into the exhaust system near the exit of the system where the combustion products are expelled into the ambient atmosphere. It is a further object of the present invention to ensure that the device is easy to install, and can be installed in a variety of different ways to maximize the effectiveness of the device.

DETAIL DESCRIPTIONS OF THE INVENTION

Figure 1:
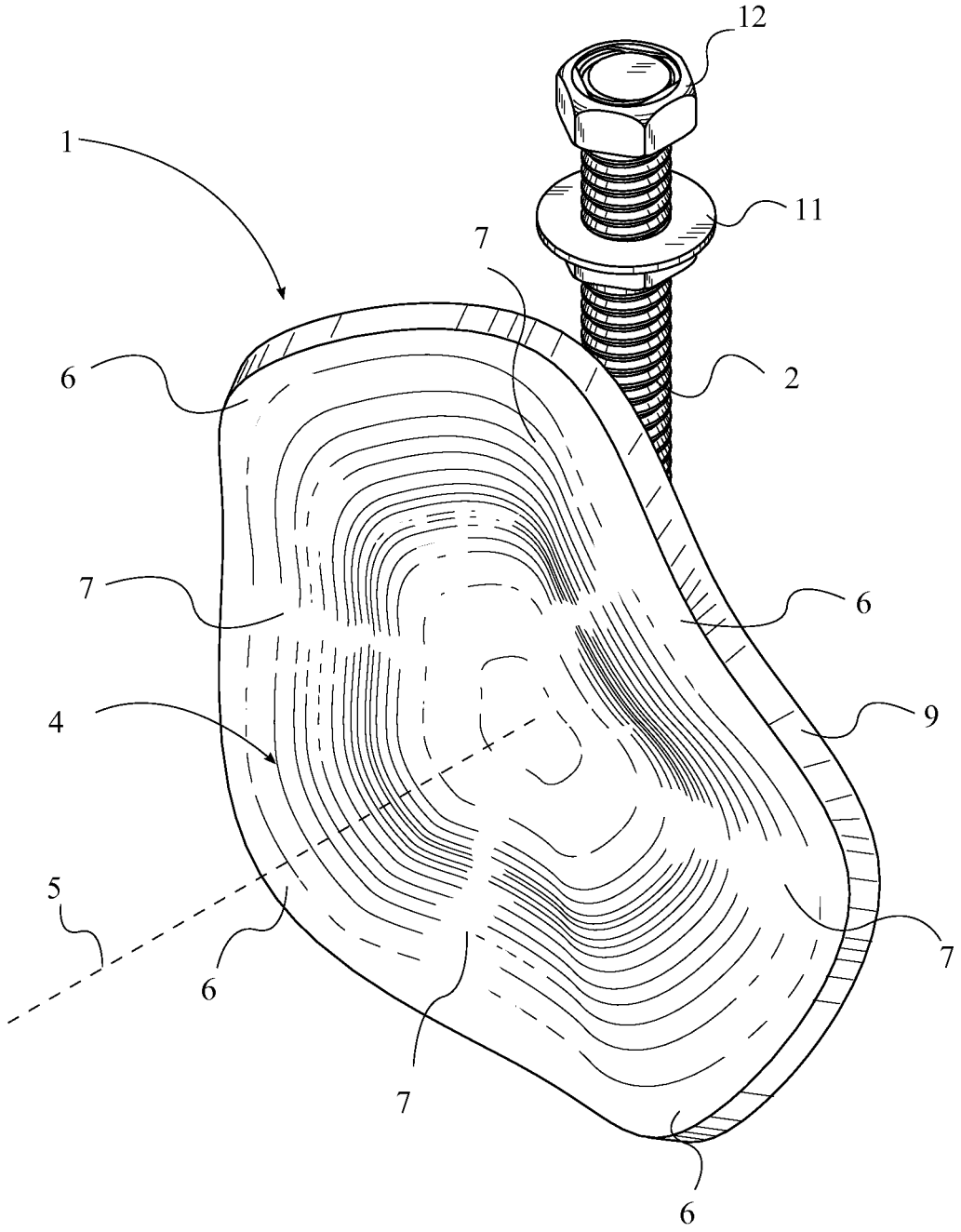
FIG. 1 is a front perspective view of the present invention.
Figure 2:
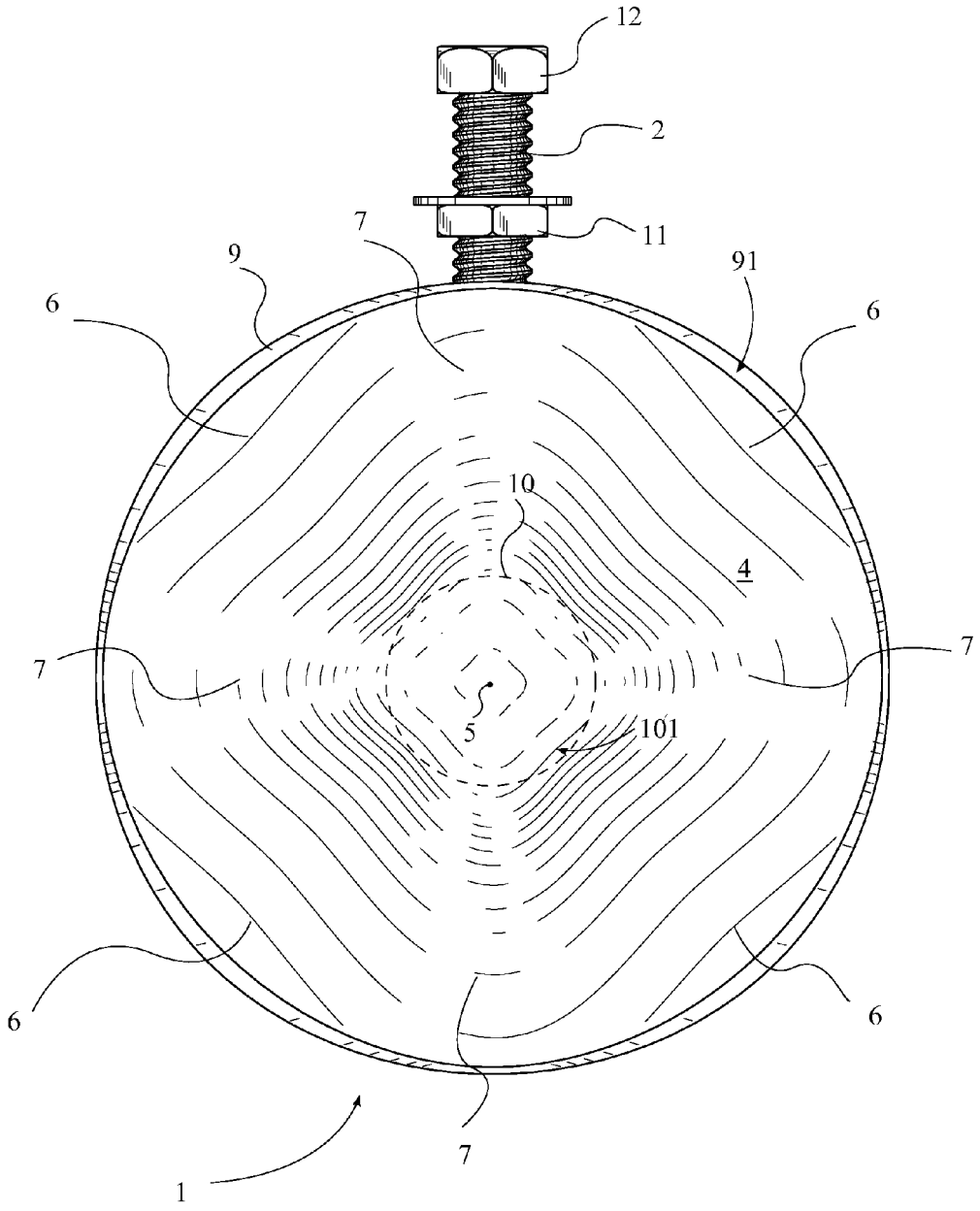
FIG. 2 is a front view of the present invention.
Figure 3:
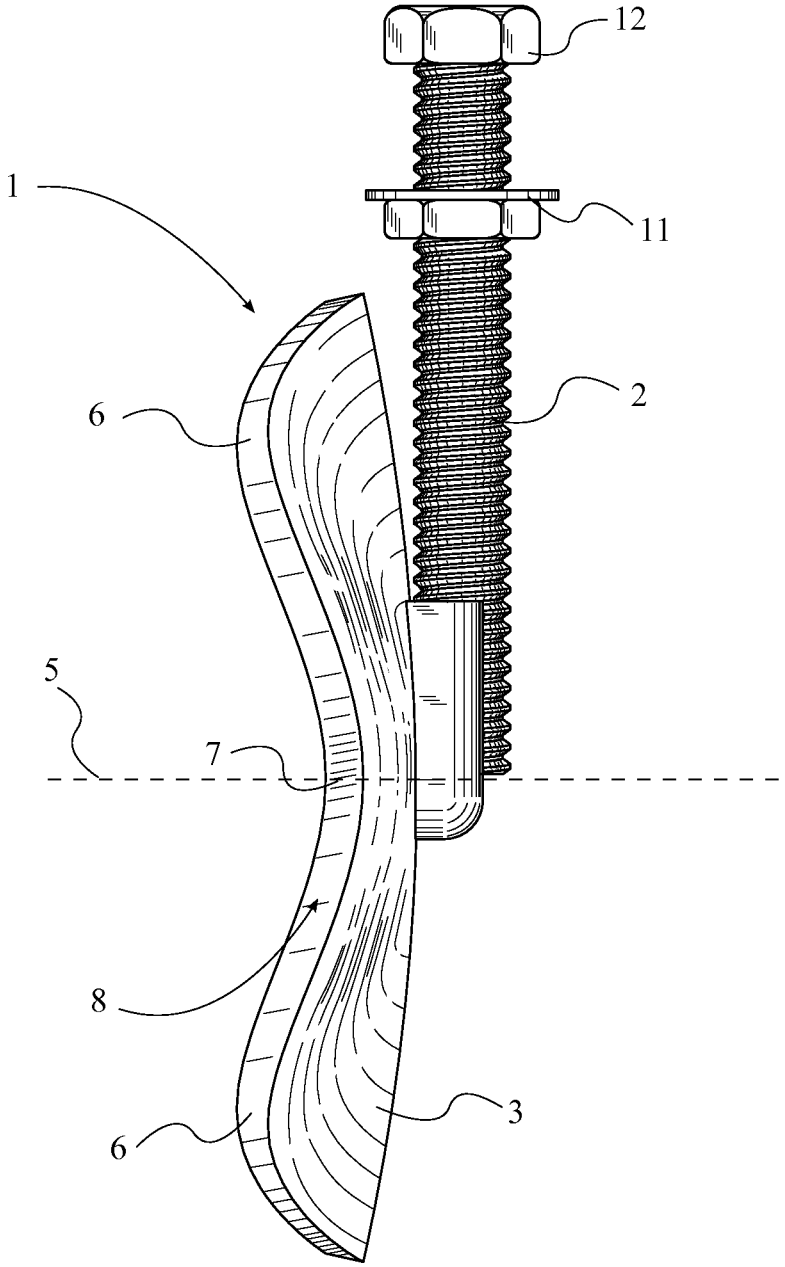
FIG. 3 is a right side view of the present invention.
Figure 4:
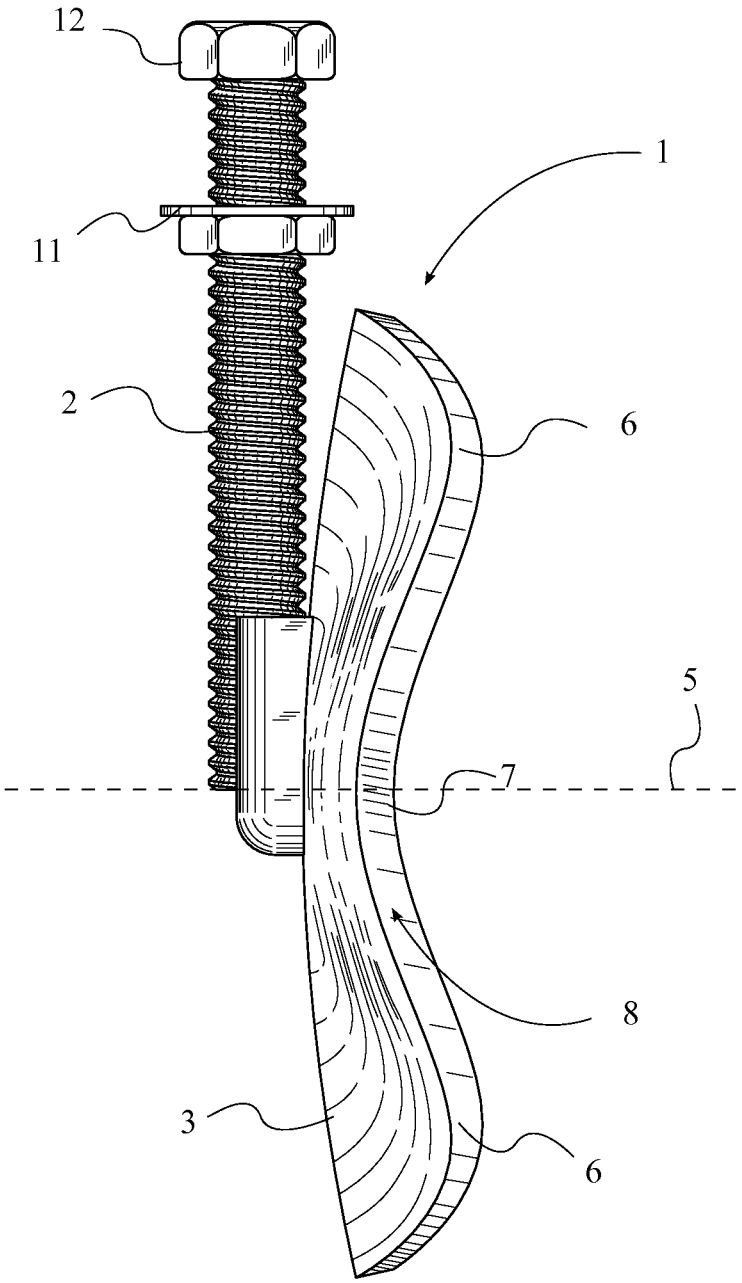
FIG. 4 is a left side view of the present invention.
Figure 5:
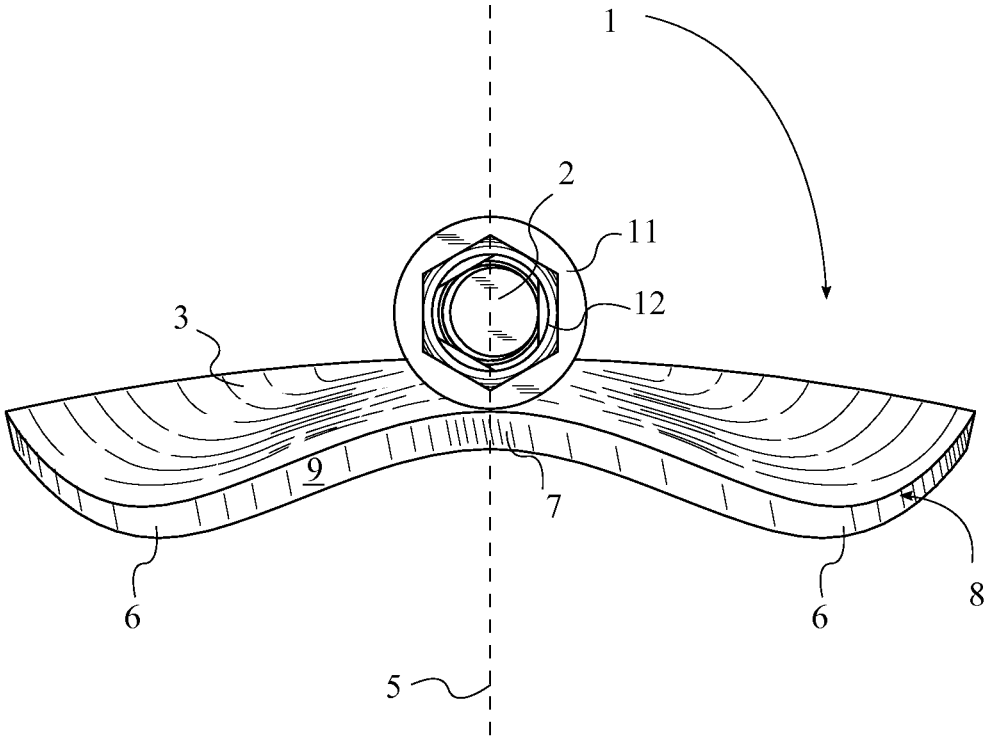
FIG. 5 is a top view of the present invention.
Figure 6:
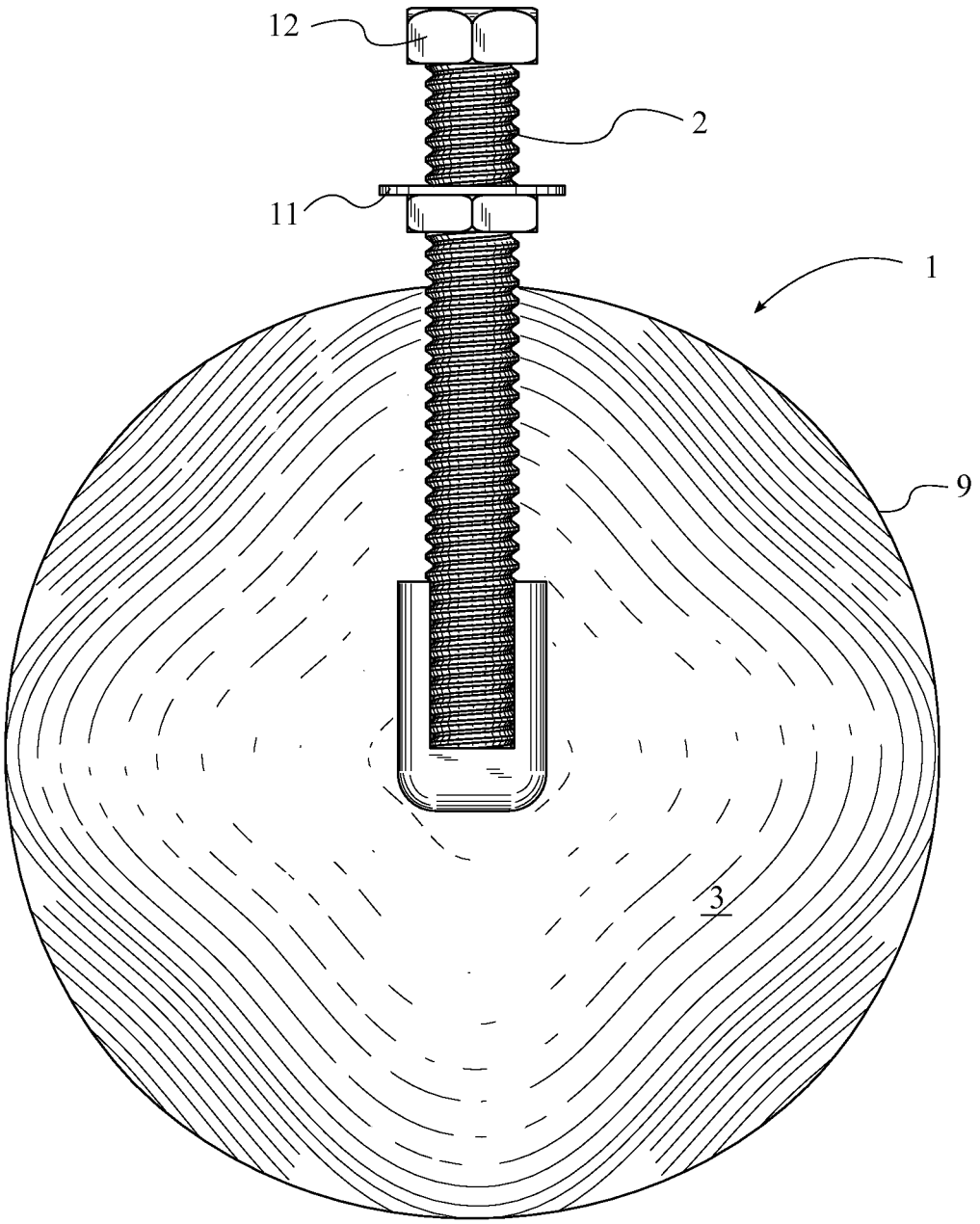
FIG. 6 is a rear view of the present invention.
Figure 7:
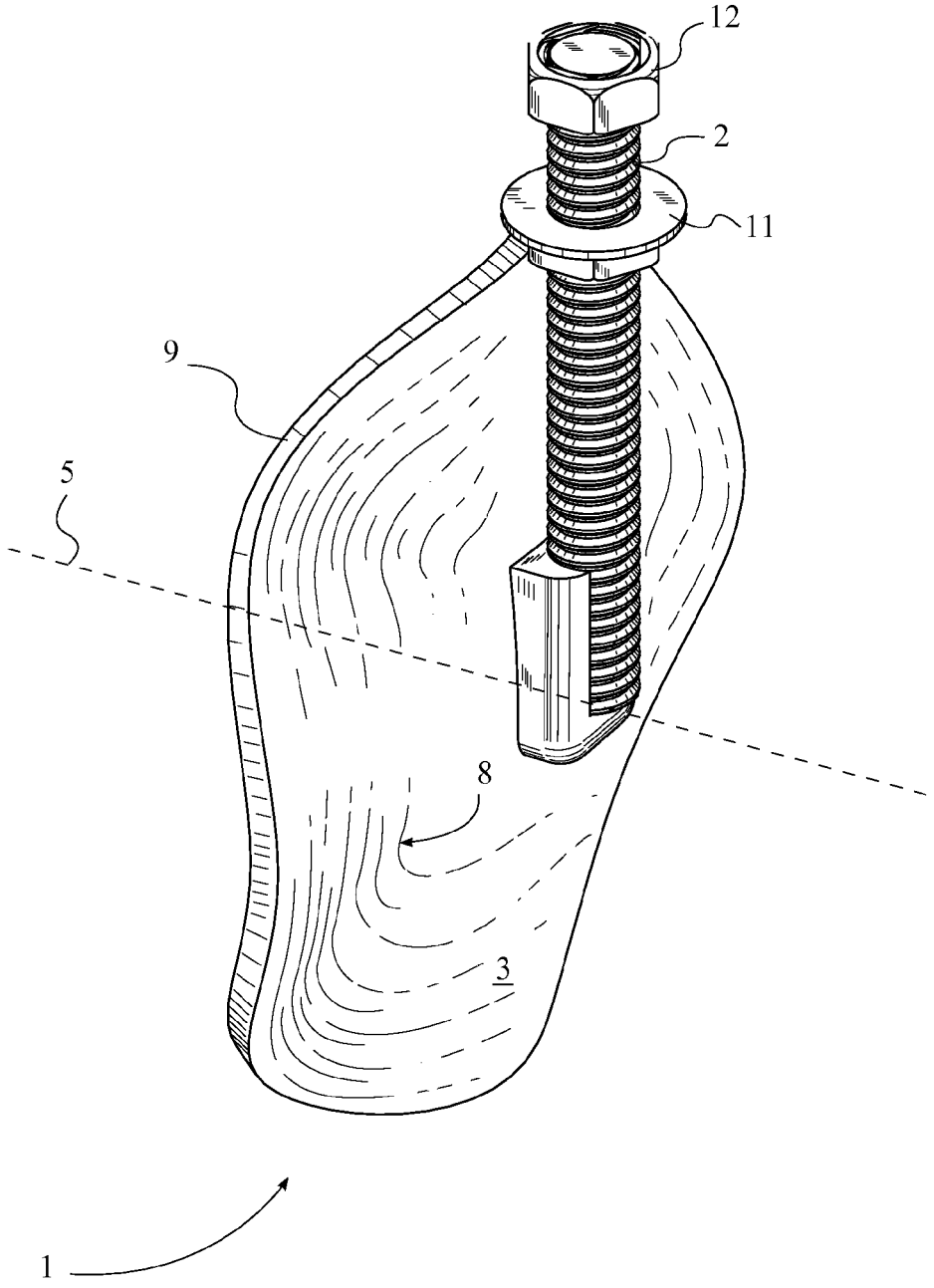
FIG. 7 is a rear perspective view of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a plate for preventing exhaust reversion, thereby increasing the exhaust gas velocity in an internal combustion engine, generally comprising a curved plate 1 and a fastener 2. The curved plate 1 is the primary component of the present invention which accomplishes the task of preventing exhaust reversion. In the preferred embodiment of the present invention, the curved plate 1 bears a sinusoidal wave shape 8 that is imparted on a flat disc by means of deforming the flat disk through applying mechanical force to the flat disk. Alternatively, the curved plate 1 may be manufactured using other methods, such as, but not limited to, injection molding or 3-dimensional printing. Deformation of the flat disk may be done manually or by a specialized machine for bending the flat disc into the curved plate 1 with the desired sinusoidal wave shape 8. It should be noted that the wave shape 8 is not strictly limited to being sinusoidal, but may simply visually resemble a sinusoidal wave.

In the preferred embodiment of the present invention, the curved plate 1 comprises a convex surface 3, a concave surface 4, a central axis 5, a plurality of peaks 6 and a plurality of valleys 7. The convex surface 3 and the concave surface 4 are positioned opposite each other on the curved plate 1, and correspond to the opposing sides of the flat disk before deformation into the curved plate 1 occurs. The central axis 5 centrally traverses through the convex surface 3 and the concave surface 4, and is equidistant from all diametrically opposed points on the perimeter 9 of the curved plate 1. It is important to note that there are a number of different materials that the plate may be manufactured out of and that it is mainly the shape, and not the material of the plate that imparts the functionality of altering the exhaust flow to prevent reversion. However, in the preferred embodiment of the present invention the curved plate 1 is made of steel. Additionally, in the preferred embodiment a textured high heat powder coat is applied to the curved plate 1 and the fastener 2. The powder coat may be implemented using many different materials available in the art of powder coating, so long as the powder coat is resistant to heat and imparts texture upon the plate surface. The powder coat covers the entirety of the curved plate 1 and part of the fastener 2.

The plurality of peaks 6 and the plurality of valleys 7 correspond to the wave shape 8 of the curved plate 1. The plurality of peaks 6 and the plurality of valleys 7 are positioned within the perimeter 9 of the curved plate 1. The plurality of peaks 6 and the plurality of valleys 7 are alternatingly positioned angularly adjacent to each other on the curved plate 1 around the central axis 5. In other words, a 360 degree arc along the curved plate 1 will encounter an alternating arrangement of peaks 6 and valleys 7: peak 6, valley 7, peak 6, valley 7, etc.

The plurality of peaks 6 are equally and angularly spaced apart from each other on the curved plate 1 around the central axis 5. Similarly, the plurality of valleys 7 are equally and angularly spaced apart from each other on the curved plate 1 around the central axis 5. In a first embodiment of the present invention, the plurality of peaks 6 comprises four peaks 6 and the plurality of valleys 7 comprises four valleys 7, which are angularly spaced apart from each other by 90 degrees. In a second embodiment of the present invention, the plurality of peaks 6 comprises three peaks 6 and the plurality of valleys 7 comprises three valleys 7, which are spaced apart from each other by 120degrees. It is additionally contemplated that in alternate embodiments there may be more than four peaks 6 and four valleys 7. In a third alternate embodiment, the curved plate 1 does not comprise a wave shape 8, but rather the curved plate 1 has a conical shape. The first embodiment is meant for large diameter exhaust applications, the second embodiment is meant for smaller applications than the first embodiment, and the third embodiment is meant for applications smaller than the second embodiment such as 1⅞" exhaust pipe.

In the preferred embodiment, the curved plate 1 of the first embodiment has a diameter of 2⅝ inches, the curved plate 1 of the second embodiment has a diameter of 1⅝ inches, and the curved plate 1 of the third embodiment has a diameter of 1⅛ inches. In the first and second embodiments, the curved plate 1 has a gage thickness of 11. In the third embodiment, the curved plate 1 has a gage thickness of 14. It should be understood that the aforementioned dimensions are for illustrative purposes only and are not intended to limit the present invention.

Each of the plurality of peaks 6 is positioned adjacent to the perimeter 9. That is to say, the uppermost point of each of the peaks 6 is positioned adjacent to, or more specifically on, the perimeter 9. Due to the geometry of a peak 6, each of the plurality of peaks 6 will also have a hill-like geometry which gradually rises from the center or near the center of the curved plate 1 towards the perimeter 9.

Each of the plurality of valleys 7 is angularly positioned between two of the plurality of peaks 6. Each of the plurality of valleys 7 is oriented perpendicular to the perimeter 9, and traverses through the central axis 5.

To more specifically describe the wave shape 8, the perimeter 9 of the curved plate 1 has a first wave shaped profile 91. The first wave shaped profile 91 resembles a sinusoidal wave that propagates angularly along the perimeter 9. An interior reference radius of the curved plate 1 is positioned within the perimeter 9 around the central axis 5. The curved plate 1 has a second wave shaped profile 101 at the interior reference radius similar to the first wave shaped profile 91, wherein the second wave shaped profile 101 resembles a sunisoidal wave that propagates angularly along the interior reference radius. The first wave shaped profile 91 and the second wave shaped profile 101 have the same period so that the first wave shaped profile 91 and the second wave shaped profile 101 have the same number of peaks 6 and the same number of valleys 7.

The curved plate 1 tapers angularly inward from the perimeter 9 to the interior diameter. In the preferred embodiment, the wave shape 8 is not present at all radiuses, and a small area between the central axis 5 and the interior reference radius is substantially flat. Alternatively, the curved plate 1 comprises the wave shape 8 at all radiuses. The difference between these two cases should not be substantial.

In order to utilize the present invention in an exhaust system, the curved plate 1 is installed within the path of the exhaust flow of an internal combustion engine. The present invention may be installed at any useful or accessible point within the exhaust path, but is generally most effective several inches from the exit of the exhaust pipe of the internal combustion engine. The curved plate 1 is installed within an exhaust pipe using the fastener 2, which is connected to the curved plate 1.

In the preferred embodiment of the present invention, the fastener 2 is a threaded stud. Alternate embodiments of the present invention may comprise alternate fastener 2 embodiments, but a threaded stud is currently the most appropriate fastener 2 for use with the present invention. Preferably, the fastener 2 is affixed to the curved plate 1 by welding, but any other appropriate means may be utilized. One end of the fastener 2 is connected to the curved plate 1, and the other end is affixed to the walls of the exhaust pipe. While it is contemplated that the fastener 2 may be connected to the curved plate 1 in any manner for appropriately supporting the curved plate 1 within the exhaust pipe, in the preferred embodiment the fastener 2 is oriented parallel to the perimeter 9 of the curved plate 1, and is connected to the convex surface 3 of the curved plate 1 at the central axis 5. A washer 2 and a locking nut 12 are used to affix the fastener 2 to the wall of the exhaust pipe, with the washer 2 and the locking nut 12 being removably engaged with the threaded stud on opposite sides of the exhaust pipe wall and pressing against the exhaust pipe wall, holding the fastener 2 and thereby the curved plate 1 in position.

The present invention may be installed within the exhaust pipe in any orientation the user desires in order to achieve the desired effect of preventing reversion of exhaust flow. For best results, however, the present invention should be installed such that the exhaust gases come into contact with the convex face. It is also important to note that the present invention may be installed such that the curved plate 1 is at an angle with the direction of the exhaust flow. Changing the angle can result in better effects depending on the exhaust system into which the present invention is installed. The present invention does not necessarily need to be centered within the exhaust pipe. The height at which the curved plate 1 is positioned within the exhaust pipe may vary as this may have different results in different exhaust systems, sometimes facilitating reversion prevention in a position that is not the direct center of the exhaust flow. Additionally, the present invention may be installed at any point inside the exhaust pipe. However, testing associated with the present invention shows that the present invention is most effective when placed anywhere from a half an inch to four inches from the exit of the exhaust system.

The main reason for reversion is expansion of the space the exhaust gas travels through. When an energy pulse traveling through the exhaust pipe reaches a portion of the exhaust system with a larger diameter, the gases lose speed. This is due to a principle of fluid flow known as volume continuity, where the volumetric flow rate through a pipe is given by the product of the average velocity of the flow and the cross sectional area of the pipe. Since the volumetric flow rate stays constant, when the cross sectional area increases, the velocity consequently decreases. When an energy pulse reaches an area with a larger cross section, part of the pulse reverses direction and impedes the flow of the exhaust gases. As previously mentioned, this results in an engine pumping loss by reducing the amount of new air and fuel which can be received into the piston chamber for the next combustion cycle.

The effect the present invention has while being positioned within an exhaust pipe is to prevent reversion, thereby speed up the flow of the exhaust gases. When the exhaust gases contact the curved plate 1, the velocity of the flow is subsequently increased due to two reasons. Firstly, the curved plate 1 reduces the area available for the exhaust gases to pass through, causing an increase in velocity due to the volume continuity. Secondly, the curved shape of the curved plate 1 reduces turbulence in the flow, aiding in the exhaust gases to flow smoothly through the pipe in a laminar flow rather than a turbulent one. When the velocity of the flow increases by passing over the curved plate 1, a vacuum is created behind the increased flow, pulling exhaust flow behind the sped-up flow due to the pressure differential.

Although the invention has been explained in relation to its preferred embodiment, it is to be understood that many other possible modifications and variations can be made without departing from the spirit and scope of the invention as hereinafter claimed.

What is claimed is:

1. An exhaust reversion prevention plate comprising:

a curved plate having a convex surface, a concave surface and a central axis;

the convex surface and the concave surface being positioned opposite each other on the curved plate;

the central axis centrally traversing through the convex surface and the concave surface;

the curved plate including a plurality of peaks and valleys alternatingly positioned on the perimeter of the curved plate such that a perimeter of the curved plate has a first sinusoidal profile propagating angularly along the perimeter;

the peaks being equally and angularly spaced about the central axis;

an uppermost point of each peak positioned on the perimeter;

the valleys being equally and angularly spaced about the central axis;

a lowermost point of each valley positioned on the perimeter;

the curved plate having an interior reference radius positioned within the perimeter of the curved plate and around the central axis;

the curved plate having a second sinusoidal profile propagating angularly along the interior reference radius;

a fastener connected to the curved plate;

the fastener being a threaded stud affixed to the curved plate;

the fastener being oriented perpendicular to the perimeter of the curved plate;

a powder coat completely covering the curved plate and part of the fastener, the powder coat being heat resistant and imparting texture to the curved plate;

a washer; and a locking nut;

the washer and the locking nut being configured to be removably engaged with the threaded stud on opposite sides of an exhaust pipe wall to press against the exhaust pipe wall, the washer and locking nut holding the curved plate in position.

2. The exhaust reversion prevention plate as claimed in claim 1 further comprising:

the curved plate tapers radially inward from the perimeter to the interior reference radius.

3. The exhaust reversion prevention plate as claimed in claim 1 further comprising:

the plurality of peaks comprises at least three peaks; and the plurality of valleys comprises at least three valleys.

4. The exhaust reversion prevention plate as claimed in claim 1 further comprising:

the plurality of peaks comprises four peaks; and the plurality of valleys comprises four valleys.

5. The exhaust reversion prevention plate as claimed in claim 1 further comprising:

the fastener being affixed to the curved plate at the central axis.

6. The exhaust reversion prevention plate as claimed in claim 1 further comprising:

the fastener being affixed to the convex surface of the curved plated.

* * * * *